US012497852B2

(12) United States Patent
Owoeye et al.

(10) Patent No.: US 12,497,852 B2
(45) Date of Patent: Dec. 16, 2025

(54) BIG BORE LOW PRESSURE SURFACE WELLHEAD HOUSING SYSTEMS

(71) Applicant: SAUDI ARABIAN OIL COMPANY, Dhahran (SA)

(72) Inventors: Oladele Owoeye, Dhahran (SA); Peter Egbe, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 48 days.

(21) Appl. No.: 18/192,556

(22) Filed: Mar. 29, 2023

(65) Prior Publication Data

US 2024/0328274 A1 Oct. 3, 2024

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS 1,662,984 A * 3/1928 Scott ..... E21B 43/127 166/85.5
1,756,597 A * 4/1930 Keenan ..... E21B 33/04 166/88.1
1,836,419 A * 12/1931 Wigle ..... E21B 33/04 285/123.3
2,118,094 A * 5/1938 McDonough ..... E21B 33/04 285/123.3
2,346,060 A 4/1944 Yeatman
3,064,734 A 11/1962 Bauer et al.
3,426,848 A * 2/1969 Kearns ..... E21B 33/04 166/88.1
3,494,421 A 2/1970 Dollison
(Continued)

FOREIGN PATENT DOCUMENTS

GB 2114184 A * 8/1983 ..... E21B 33/04

OTHER PUBLICATIONS

SLB Energy Glossary entry for "wellhead", as it appeared Oct. 2, 2022 (Year: 2022).*

(Continued)

*Primary Examiner* — Blake Michener
(74) *Attorney, Agent, or Firm* — Vorys, Sater, Seymour and Pease LLP

(57) ABSTRACT

A well system includes a wellbore, a conductor extended within the wellbore, and a wellhead installation arranged at an opening to the wellbore. The wellhead installation includes a low-pressure surface wellhead housing (LPWH) having opposing upper and lower ends, an extension joint secured to the lower end at an offsite location prior to delivery to the wellbore, an extended casing head housing (ECHH) providing a body having opposing first and second ends and sized to be received within the LPWH, the second end being secured to an uphole end of surface casing at an offsite location prior to delivery to the wellbore, and one or more annulus valves extending through a sidewall of the LPWH to provide fluid communication with a conductor-casing annulus defined between the conductor and the surface casing when the ECHH is received within the LPWH.

20 Claims, 6 Drawing Sheets

(56) References Cited

U.S. PATENT DOCUMENTS

| | | | | | |
|---|---|---|---|---|---|
| 3,844,323 | A | | 10/1974 | Anderson, Jr. | |
| 4,697,828 | A | * | 10/1987 | Chou | E21B 33/04 285/123.4 |
| 5,066,048 | A | * | 11/1991 | Farrell | F16L 37/098 285/23 |
| RE34,071 | E | * | 9/1992 | Van Bilderbeek | E21B 33/04 166/368 |
| 6,202,745 | B1 | | 3/2001 | Reimert et al. | |
| 7,779,921 | B2 | | 8/2010 | Cain et al. | |
| 9,416,600 | B2 | | 8/2016 | Golovinskij | |
| 11,585,182 | B1 | * | 2/2023 | Egbe | E21B 33/04 |
| 2004/0163816 | A1 | | 8/2004 | Nelson et al. | |
| 2014/0238693 | A1 | * | 8/2014 | Adkinson | E21B 43/2607 166/382 |
| 2014/0251634 | A1 | | 9/2014 | Curtiss et al. | |
| 2016/0040499 | A1 | | 2/2016 | Cain et al. | |
| 2016/0222747 | A1 | * | 8/2016 | Rose | E21B 43/10 |

OTHER PUBLICATIONS

SLB Energy Glossary entry for "conductor pipe", as it appeared on May 31, 2012 (Year: 2012).*

SS-15 Big Bore II Subsea Wellhead System to Dril-Quip; retrieved from https://www.dril-quip.com/resources/catalogs/04.%20SS%20Series%20Subsea%20Wellhead%20Systems.pdf.

* cited by examiner

BIG BORE LOW PRESSURE SURFACE WELLHEAD HOUSING SYSTEMS

FIELD OF THE DISCLOSURE

The present disclosure relates generally to wellheads in the oil and gas industry and, more particularly, to low-pressure wellhead housing systems that can accommodate two conductor strings.

BACKGROUND OF THE DISCLOSURE

Wellheads are a required and essential component for every oil and gas well drilled and completed for production. Wellheads serve a variety of purposes, such as acting as a sealed barrier between the wellbore and the atmosphere. The wellhead also provides load support for each tubular run (extended) into the wellbore. In addition, the wellhead facilitates production of downhole fluids as it is the connection point from the downhole tubulars to the surface production equipment.

Although wellheads are commonly utilized, surface positioned wellheads (whether onshore or offshore) generally lack the tailored design, configuration, and installation capabilities of subsea wellheads most often utilized in deepwater wells. Often this is due to the subterranean conditions and operational complexity that is associated with deepwater well construction. However, as land positioned and shallow water wells advance into varying subterranean conditions and increase in operational complexity, advancement in surface located wellheads is desirable.

Some wellhead designs are prone to wellhead movement and, more particularly, to relative movement between the casing head housing and the surface wellhead housing. This relative movement can also be experienced in subsequently installed drilling spools between their corresponding hanger systems and the outermost conductor string. Such movement can result in damage to the weld(s) between the outermost casing string and the casing head housing. Movement can also result in recurring leaks from the conductor-conductor annulus and the conductor-casing annulus in offshore operations. Recurring leaks may require well shut-in and costly/extensive wellhead repair to restore production.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a wellbore penetrating a subterranean formation wherein a conductor may be extended within the wellbore, and a wellhead installation may be arranged at an opening to the wellbore and securable to the conductor. The wellhead installation may include a low-pressure surface wellhead housing (LPWH) having opposing upper and lower ends and an extension joint that may be secured to the lower end of the LPWH at an offsite location prior to delivery to the wellbore, wherein the extension joint may be threadably engageable with an upper end of the conductor at the wellbore. The wellhead installation may also include an extended casing head housing (ECHH) providing a body having opposing first and second ends that may be sized to be received within the LPWH, wherein the second end may be secured to an uphole end of surface casing at an offsite location prior to delivery to the wellbore. The wellhead installation may further include one or more annulus valves extending through a sidewall of the LPWH to provide fluid communication with a conductor-casing annulus defined between the conductor and the surface casing when the ECHH is received within the LPWH.

According to an embodiment consistent with the present disclosure, a method of assembling a wellhead installation may include receiving a low-pressure surface wellhead housing (LPWH) and an extended casing head housing (ECHH) at a wellbore of a well site, wherein an extension joint may be secured to a lower end of the LPWH at an offsite location prior to delivery to the wellbore, and an end of the ECHH may be secured to an uphole end of surface casing at an offsite location prior to delivery to the wellbore. The method may further include lowering the LPWH toward the wellbore and threading the extension joint to an upper end of a conductor extended within the wellbore, lowering and receiving the ECHH within the LPWH, and facilitating communication with a conductor-casing annulus defined between the conductor and the surface casing with one or more annulus valves extending through a sidewall of the LPWH.

According to an embodiment consistent with the present disclosure, a low-pressure surface wellhead housing (LPWH) unit may include a body having opposing upper and lower ends and providing an interior bowl, an extension joint that may be secured to the lower end of the LPWH at an offsite location prior to delivery to a wellbore, wherein the extension joint may be threadably engageable with an upper end of a first conductor receivable within a wellbore. The LPWH unit may also include a lower landing shoulder defined within the interior bowl and configured to receive and land a second conductor arranged concentric within the first conductor, an upper landing shoulder defined within the interior bowl axially above the lower landing shoulder and that may be configured to receive and land an extended casing head housing (ECHH), the ECHH providing a body having opposing first and second ends, wherein the second end may be secured to an uphole end of surface casing at an offsite location prior to delivery to the wellbore. The LPWH unit may also include one or more monitoring outlets extending through a sidewall of the LPWH to provide fluid communication with a conductor-conductor annulus defined between the first and second conductors when the second conductor is received within the LPWH. The LPWH unit may further include one or more annulus valves extending through a sidewall of the LPWH to provide fluid communication with a conductor-casing annulus defined between the conductor and the surface casing when the ECHH may be received within the LPWH.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
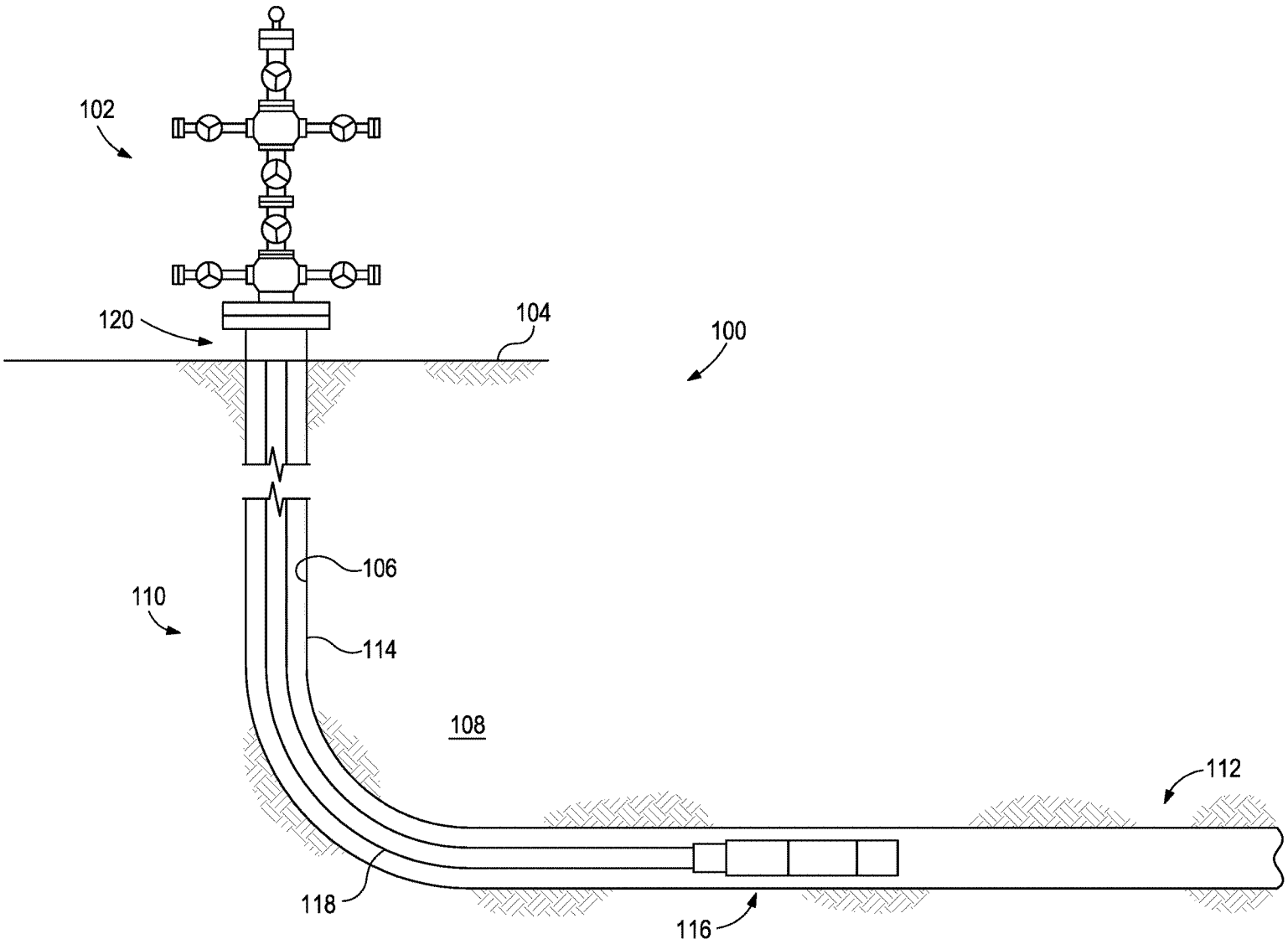
FIG. 1 is an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been 00apparent to one of ordinary skill in the art that the scale of the elements presented in the accompanying Figures may vary without departing from the scope of the present disclosure.

Embodiments in accordance with the present disclosure generally relate to installation of a wellhead system, and more particularly, to the installation of a big-bore (or alternatively, a large-bore) wellhead system for surface located wellheads in either onshore or offshore (i.e., platform positioned) wells. Specifically, the surface wellhead disclosed herein describes a system of housings that may accommodate multiple conductor casings, provide access to annuli that are conventionally inaccessible, and incorporates matability/connection between housings that reduces movement between tubulars and the wellhead housings. Additionally, methods of installing the surface wellhead embodiments are disclosed herein and may help reduce the expenditure of critical path non-productive time.

FIG. 1 is an example well system 100 that may employ one or more principles of the present disclosure, according to one or more embodiments. As illustrated, the well system 100 includes a wellhead installation 102 positioned on the Earth's surface 104 and extending over and around a wellbore 106 that penetrates a subterranean formation 108. In some applications, the wellhead installation 102 may be used for production operations, but could alternatively be used for drilling and completion operations in accordance with the principles of the present disclosure. While the well system 100 is depicted as a land-based operation, it will be appreciated that the principles of the present disclosure could equally be applied in any offshore, sea-based, or sub-sea application where the wellhead installation 102 may be arranged on a floating platform, a semi-submersible platform, or may comprise a sub-surface wellhead installation as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the Earth's surface 104 and transition into a substantially horizontal wellbore portion 112. In some embodiments, the wellbore 106 may be completed by cementing a casing string 114 within the wellbore 106 along all or a portion thereof. In other embodiments, however, the casing string 114 may be omitted from all or a portion of the wellbore 106 and the principles of the present disclosure may equally apply to an "open-hole" environment.

The system 100 may further include a downhole tool 116 that may be conveyed into the wellbore 106 on a conveyance 118 that extends from the wellhead installation 102. In some applications, the downhole tool 116 may comprise a drilling assembly, but in other embodiments the downhole tool 116 may comprise a completion assembly configured for production operations. Accordingly, the conveyance 118 that delivers the downhole tool 116 into the wellbore 106 may be, but is not limited to, casing, coiled tubing, drill pipe, tubing, wireline, slickline, an electric line, or the like.

The wellhead installation 102 may include at least a big bore low-pressure wellhead housing system 120. The big bore low-pressure wellhead housing system 120 (hereafter the "wellhead housing system 120") may include numerous devices, spools, housings, and hangers configured to retain and support the strings of casing 114 extending into the wellbore 106. For example, and as described in more detail below, the wellhead housing system 120 may include a surface wellhead housing unit and a casing head housing configured to be received within the surface wellhead housing unit. One common concern in wellhead housing systems, such as the wellhead housing system 120, is wellhead movement and the lack of interaction between the casing head housing and the outermost casing string, which typically results in relative movement between the casing head housing and the outermost string. This relative movement is also experienced between subsequent drilling spools (with their corresponding hanger systems) and the outermost conductor string.

According to embodiments of the present disclosure, the wellhead housing system 120 may constitute an improved big bore low-pressure surface wellhead housing system demonstrating different techniques of installation. As described herein, an extended casing head housing unit forming part of the wellhead housing system 120 may be locked and preloaded depending on the type of application, such as whether another conductor string is required (or not) prior to deploying the surface casing with the extended casing head housing. The system can be integrated with conventional drilling spools, multi bowl and uni-head wellhead systems. Moreover, the embodiments described herein may help mitigate damage to the weld between the casing head housing and the outermost conductor string, which oftentimes occurs as a result of fatigue load, wellhead movement during installation and/or production operations (e.g., wellhead growth), and transfer of high compressive load forces through a poor-quality weld to the outermost conductor string. Embodiments discussed herein may also help mitigate recurring leaks from the conductor-conductor annulus and the conductor-casing annulus in conventional big-bore gas well designs. Such leaks often result in well shut in or loss of potential and costly wellhead repairs to restore production.

Figure 2:
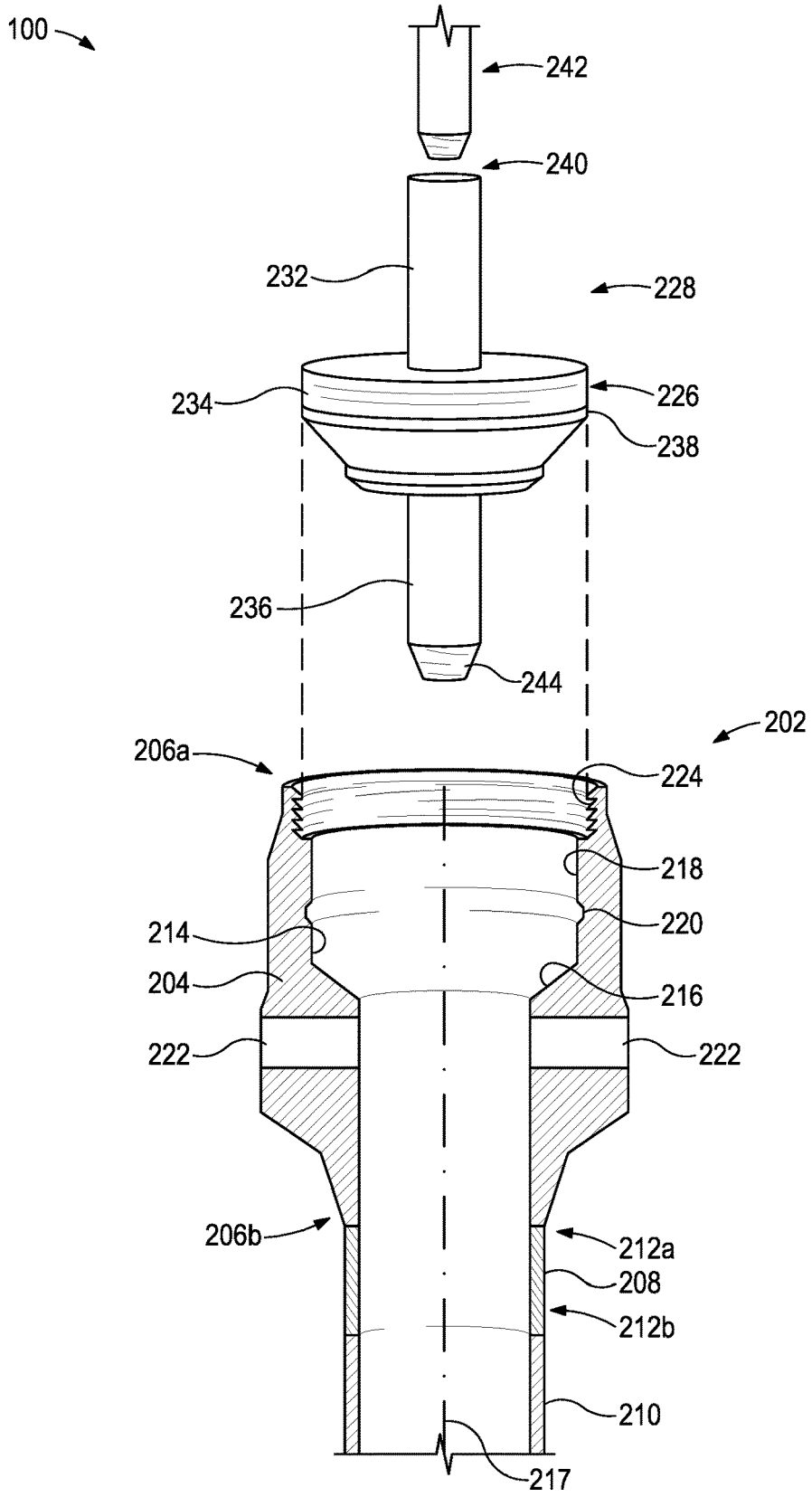
FIG. 2 is a schematic diagram of an example low-pressure surface wellhead housing unit, according to one or more embodiments of the disclosure.

FIG. 2 is a schematic diagram of an example low-pressure surface wellhead housing unit 202, according to one or more embodiments of the disclosure. The low-pressure surface wellhead housing unit 202 (hereafter the "low-pressure wellhead 202" or "LPWH 202") may form part of the wellhead housing system 120 of FIG. 1, and may thus be used with the well system 100 of FIG. 1. Accordingly, when installed, the LPWH 202 may be situated at a wellsite located on the Earth's surface (i.e., a land-based operation), but could alternatively be operable in a subsea well environment where the wellhead may be installed on the surface of a platform (or similar), without departing from the scope of the disclosure. The LPWH 202 may be configured for operation with a hydrocarbon producing well, but could alternatively be configured for operation with a water supply well, without departing from the scope of the disclosure.

The LPWH 202 comprises a generally cylindrical body 204 having an upper end 206*a* and a lower end 206*b* opposite the upper end 206*a*. The lower end 206*b* of the LPWH 202 may be operatively coupled to an extension joint 208. As depicted, extensions of conductor casing 210 (hereafter "conductor 210") may be operatively coupled to the body 204 through (via) the extension joint 208. As used herein, the term "operatively couple" refers to a direct or indirect coupling engagement between two components.

Conventionally in wellbore construction of the type disclosed, construction begins with the outermost or largest diameter conductor pipe (sometimes referred to as drive pipe or conductor casing), wherein the conductor pipe may be driven, hammered, or similarly jet into place. The conductor serves as the initial structural support of the well in preventing potential cave-in of the unconsolidated sediment that often makes up the uppermost layer of the subterranean surface. In some embodiments, once driven to a predetermined depth, some footage of the conductor may visibly extend above the surface of the subterranean. Accordingly, some portion of the extended conductor may be circumferentially cut (by any known means). In some embodiments, the operator may choose to install a base plate, wherein the top cut of the conductor provides a level surface for a base plate. Accordingly, a base plate (or alternatively, a casing head support unit (CHSU)) may be welded to the top of the conductor.

The base plate or CHSU serve to support the housings (via transfer of compressional load) that will be installed as wellbore construction progresses. With the conductor set in place (regardless of whether the base plate is installed) the next borehole section may be drilled through the conductor to a depth wherein a smaller diameter tubular/casing may be positioned and cemented into the place. Most often this secondary section of tubular is termed surface casing. Once positioned at its distal depth, some predetermined portion of the surface casing extends above the subterranean floor. Routinely (and similar to the conductor), the extended surface casing will be cut circumferentially to accommodate the placement and connection of a surface casing head housing (i.e., low-pressure wellhead housing). Generally, the surface casing head is then directly coupled to the cut extension of surface casing by means of a circumferential weld. In such an embodiment, the conductor pipe is not operatively nor communicably coupled to the surface casing head housing in any way. Consequently, the conductor remains freestanding. A lack of coupling and connection between the conductor and the low-pressure surface casing head housing may result in relative movement between the conductor and the surface casing head as additional housings are added and similarly, when the well is put on production. Absence of coupling further imparts the majority of the surface casing load (and any subsequent housing loads) to the surface casing. Similarly, the lack of coupling between the conductor and the surface casing head eliminates the ability to monitor the annulus between the conductor and the surface casing string.

Additionally, the surface casing cutting and welding to the low-pressure wellhead housing is generally performed onsite and during operational time, thus extending the "flat time" associated with the wellbore. (Those of ordinary skill will be familiar with the term "flat time" wherein required operations are performed that do not include advancing the wellbore depth (i.e., setting casing, cementing, etc.), thus decreasing the well's performance in terms of critical path, productive time) As a result, it is advantageous to limit the well's flat time as much as is operationally feasible.

According to embodiments of the present disclosure, a LPWH 202 may be directly coupled to the conductor 210 as opposed to the surface casing. Such an embodiment enables direct connection and monitoring capability between the conductor 210 and the surface casing, as discussed in more detail below. Accordingly, the lower end 206*b* of the LPWH 202 may be finished with a plain end enabling a welded connection directly to an extension joint 208.

The extension joint 208, as illustrated in FIG. 2, comprises a generally cylindrical hollow body having an "upper" end 212*a* and a "lower" end 212*b* opposite the upper end 212*a*. The upper end 212*a* of the extension joint 208 may be similarly finished with a plain end enabling a welded connection to the lower end 206*b* of the LPWH 202. In other embodiments, the lower end 206*b* of the LPWH 202 may be finished via bevel, thread, or by any other known means of matable connection that would permit coupling to the extension joint 208. The lower end 212*b* of the extension joint 208 may be configured to be operatively coupled to the outer most tubular. In the illustrated embodiment, the outermost tubular is the conductor 210, which has been jet and set in place (not shown). Varying from the conventional conductor jet-in procedures discussed above, the uppermost portion of the conductor 210 that extends above the subterranean floor (after the conductor 210 has been driven in place) will not be cut nor welded. This enables the lower end 212*b* of the extension joint 208 and the uppermost exposed portion of the conductor 210 (i.e., box connection) to directly couple by means of a threaded engagement, e.g., American Petroleum Institute (API) threads. In other embodiments, the threads of the lower end 212*b* of the extension joint 208 may be manufactured as necessary to properly make up to the conductor 210.

In the present embodiment, the welded connection between the lower end 206*b* of the LPWH 202 and the upper end 212*a* of the extension joint 208 may be performed offsite, thus eliminating the flat time associated with the cut and weld of the surface casing to the low-pressure surface casing housing. Equally, if not more beneficial, offsite welding creates more assurance in the quality of the weld. Traditionally, where onsite weld procedures have been utilized, well integrity concerns arise when the well is produced long-term. Often the weld performed onsite is not of the same quality as when performed in a controlled offsite setting without time constraints. Accordingly, the operative coupling of the LPWH 202 to the extension joint 208 performed offsite is more likely to produce a more effective connection.

In at least one embodiment, as briefly mentioned above, the lower end 212*b* of the extension joint 208 may be threadably attached to the conductor 210 using American Petroleum Institute (API) machined threads, for example. In other embodiments, the extension joint 208 may be coupled to the conductor 210 using any known means in accordance with the requirements of the applicable regulatory body. Additionally, the extension joint 208 may be configured be operable and compatible with a size of the conductor 210 ranging from 28 inch outer diameter to 36 inch outer diameter. The annular body of the extension joint 208 exhibits an outer diameter that may match or otherwise align with the outer diameter of the conductor 210.

Referring again to the LPWH 202, the body 204 further defines or provides a bowl 214, which constitutes the interior and some or all of the inner radial surfaces of the body 204. In some embodiments, an angled landing shoulder 216 may be defined within the bowl 214 and operable to receive and seat an extended casing head housing unit (not shown), as described in more detail below. In some embodiments, the landing shoulder 216 may be angled at 45° relative to a centerline 217 of the LPWH 202. In other embodiments, however, the landing shoulder 216 may be provided at an angle greater than or less than 45°, without departing from the scope of the disclosure, and in order to receive a compatible extended casing head housing unit.

The bowl 214 may also define a sealing surface 218 that provides a location to generate a sealed interface between the LPWH 202 and the extended casing head housing, as discussed below. Moreover, the bowl 214 may further define or provide a lock-ring groove 220 compatible to receive and seat a lock-ring (not shown) disposed about the exterior of the extended casing head housing. The lock-ring, when engaged, may assist in reducing the relative movement between the LPWH 202 and the extended casing head housing, as well as any subsequent housings installed within the wellhead housing system 120.

The LPWH 202 may further include one or more annulus valves 222. In the illustrated embodiment, two annulus valves 222 are angularly offset from each other by 180°. The annulus valve(s) 222 may be defined in the body 204 so that they extend through the sidewall to provide a means for fluid communication, pressure monitoring, or otherwise from outside of the wellhead housing system 120 (FIG. 1). In at least one embodiment, as illustrated, the annulus valve(s) 222 may be positioned axially below both the lock-ring groove 220 and the landing shoulder 216. The annulus valve(s) 222 may provide the means to monitor a conductor-casing annulus defined between the outermost conductor 210 and the tubular disposed/positioned immediately within the conductor 210 (e.g., a surface casing). In at least one embodiment, the annulus valve(s) 222 may be positioned such that the conductor-casing annulus formed between the conductor 210 and a surface casing may be monitored. In other embodiments, the annulus valve(s) 222 may be positioned below the lock-ring groove 220 and above the landing shoulder 216. In such embodiments, as discussed in more detail below, the annulus valve(s) 222 may be operable for testing the sealing efficiency between the interior sealing surface 218 and any seal or pack-off that may be installed around the exterior of an extended casing head housing arranged within the bowl 214.

The body 204 may further provide or otherwise define an internally-threaded profile 224 configured to threadably engage a corresponding externally-threaded profile 226 provided on a running tool 228. The running tool 228 may be configured to threadably engage the LPWH 202 at the corresponding threaded profiles 224, 226 and thereby provide a means to convey and position the LPWH 202 as procedurally required. As illustrated, the running tool 228 includes an upper or top sub 232, a mid-body 234, and a lower or bottom sub 236. The mid-body 234 axially interposes the top and bottom subs 232, 236, which extend axially away from the mid-body 234 in opposing directions.

The mid-body 234 exhibits a diameter that is greater than the diameters of both the top and bottom subs 232, 236. Further, the externally-threaded profile 226 may be provided on the mid-body 234 and configured to threadably mate with the internally-threaded profile 224 of the LPWH 202. In some embodiments, as illustrated, one or more elastomeric seals 238 (one shown) may also be provided on the mid-body 234 and configured to sealingly engage the sealing surface 218 provided within the bowl 214 of the of the LPWH 202 when the running tool 228 is operatively coupled to the LPWH 202.

The top sub 232 of the running tool 228 comprises a generally cylindrical hollow body with an upper box connection 240 configured to be operatively coupled to a conveyance means, such as drill pipe 242 (or similarly, a landing string) including corresponding pin-end threads, e.g., American Petroleum Institute (API) threads. In other embodiments, the threads of the running tool 228 may be manufactured as necessary to properly make up to the desired form of conveyance which may include any known means of conveyance. The top sub 232, accordingly, may comprise an outer diameter similar to that of the drill pipe 242.

Similarly, the bottom sub 236 comprises a generally cylindrical hollow body with a lower pin connection 244 configured to be operatively coupled to any desirable or necessary downhole component(s) applicable to running the LPWH 202. In some embodiments, for example, the pin connection 244 may be configured to be operatively coupled to a jet sub (not shown) that may be operable to clean (i.e., jet) the interior of the LPWH 202.

Once the extensions of the conductor 210 have been jet or driven to their required depth, the running tool 228 may be directly coupled to the LPWH 202 via the threaded engagement between the opposing threaded profiles 224, 226. Following makeup, the combination running tool 228 and LPWH 202 (collectively referred to as a "downhole assembly") may be conveyed (run) via the drill pipe 242. The downhole assembly may be lowered toward the installed conductor 210, which, as mentioned above, the upper-most extension of the conductor 210 comprises a box connection with an API thread matable to the threads of the lower end **212*b* of the extension joint 208. Upon makeup of the extension joint 208 and the upper-most conductor 210, the running tool 228 may disengage (unthread) from the LPWH 202, and be removed (or conveyed upward) by removing extensions of the drill pipe 242**.

Figure 3:
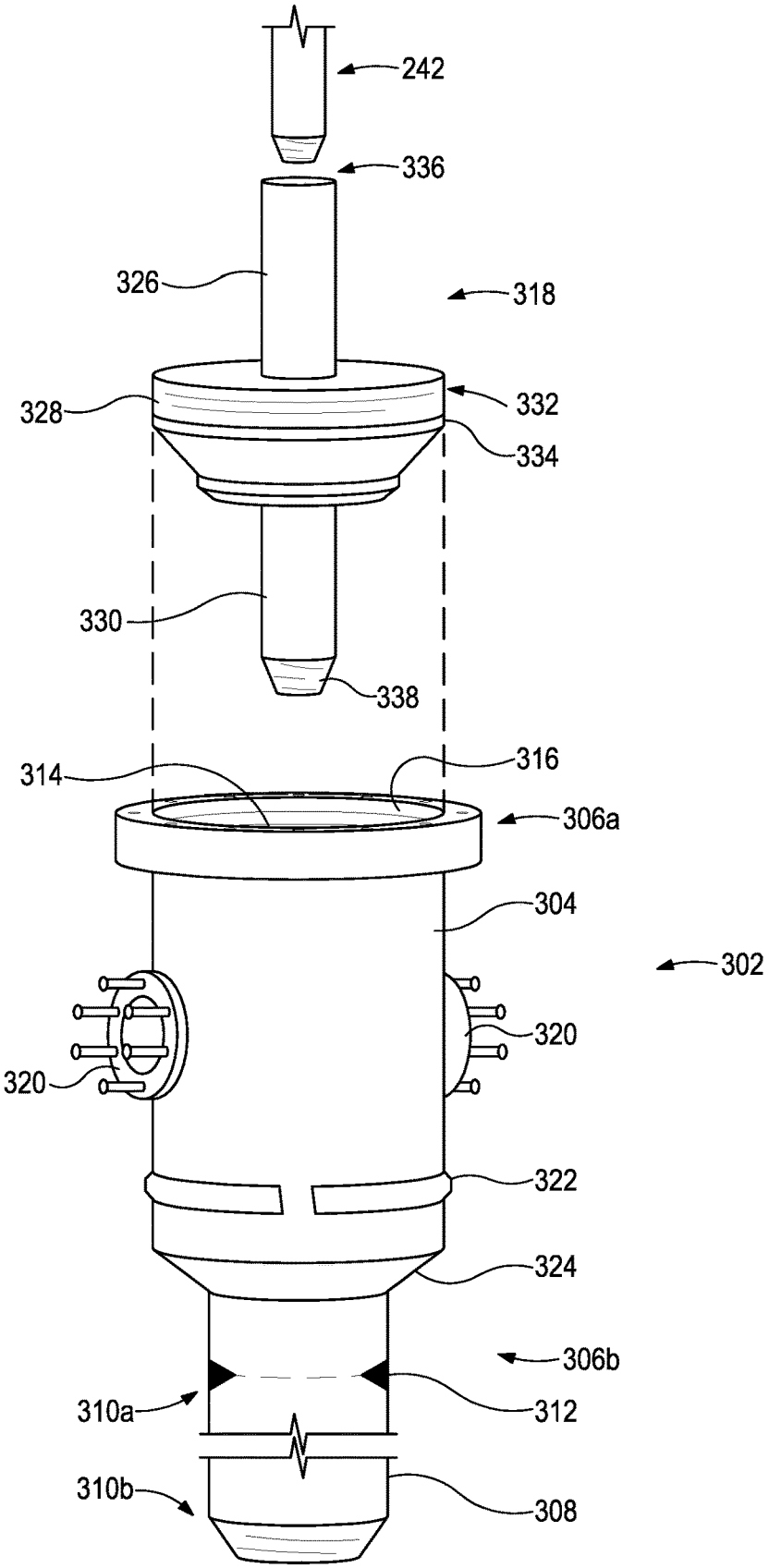
FIG. 3 is a schematic view of an example extended casing head housing, according to one or more embodiments of the present disclosure.

FIG. 3 is a schematic view of an example extended casing head housing 302, according to one or more embodiments of the present disclosure. The extended casing head housing (hereafter the "ECHH 302") may form part of the wellhead housing system 120 of FIG. 1. Accordingly, when installed, the ECHH 302 may be situated at a wellsite located on the Earth's surface (i.e., a land-based operation), but could alternatively be operable in a subsea well environment where the wellhead may be installed on the surface of a platform (or similar), without departing from the scope of the disclosure.

As illustrated, the ECHH 302 may include a generally cylindrical and hollow body 304 having a first or "upper" end **306*a* and a second or "lower" end 306*b* opposite the upper end 306*a*. The body 304 may be designed or otherwise sized to be received within, sealingly engage, and secured to the body 204 (FIG. 2) of the LPWH 202 (FIG. 2). The ECHH 302 may operate to support the weight of a surface casing 308 operatively coupled to and extending below the ECHH 302. Additionally, once installed, the ECHH 302** may help support the subsequently installed wellhead housings.

In the illustrated embodiment, the upper end 306*a* provides or otherwise includes a flanged connection interface. The flanged connection may be operable to directly couple the ECHH 302 to an upper/subsequent wellhead housing (e.g., a drilling spool, a multi-bowl, or a UNIHEAD® wellhead housing) that may be included within the wellhead housing system 120 (FIG. 1). In embodiments where the upper end 306*a* includes a flanged connection interface, as illustrated, an external hydraulic system may be required to lock and preload the ECHH 302 to the LPWH 202 (FIG. 2). In other embodiments, however, the upper end 306*a* may comprise a studded connection. In such embodiments, the ECHH 302 may be locked and preloaded to the LPWH 202 by the same external hydraulic system or alternatively by using a hydraulic setting tool. In either embodiment, when preloading the ECHH 302 within the LPWH 202, compressive force is applied. The applied compressive force remains within the ECHH 302 so that when the well is put on production, whereupon the wellhead housing system 120 may experience tensile force, the pre-installed compressive force may resist the tensile force, resulting in little to no axial movement within the wellhead housing system 120.

The lower end 306*b* may be finished with a plain end, which enables the lower end 306*b* to be connected to an extension of surface casing 308. More particularly, the extension of surface casing 308 may comprise a generally cylindrical, and tubular body having a first or "uphole" end 310*a*, and the uphole end 310*a* may be previously cut and finished with a plain end, which enables the surface casing 308 to be attached to the lower end 306*b* at a welded interface 312. Similar to the welding operations discussed in reference to FIG. 1, the welded interface 312 between the ECHH 302 and the extension of surface casing 308 may be executed at an offsite location. Such offsite welding operations ensure a better quality weld and less concern about pressure containment during future production of the associated wellbore. In other embodiments, the lower end 306*b* of the ECHH 302 may be finished via bevel, thread, or by any other known means of matable connection that would permit coupling to the extension of surface casing 308.

The surface casing 308 further includes a second or "downhole" end 310*b* opposite the uphole end 310*a*. The downhole end 310*b* may include matable connections operable to mechanically secure and sealingly engage additional extensions of the surface casing 308. In at least one embodiment, for example, the downhole end 310*b* may provide American Petroleum Institute (API) machined threads. In other embodiments, however, the downhole end 310*b* may provide other types of matable connections in accordance with requirements of the applicable regulatory body.

The ECHH 302 further includes an internal through bore 314 extending between the upper and lower ends 306*a,b* and constituting the interior and inner radial surfaces of the body 304. The internal through bore 314 may be configured to receive a casing hanger (not shown) for subsequent casing conveyances/runs. In some embodiments, an internal thread profile 316 may be defined within the body 304 and in the through bore 314 to operatively couple the ECHH to a running tool 318, as discussed in more detail below.

Additional casing strings may require the utilization of a hanger device to suspend the casing within the wellhead housing system 120 (FIG. 1). Conventional wellhead systems may only be compatible with mandrel hangers that are emplaced within the appropriate casing head housing. A mandrel-type hanger may require remedial action should the casing string be stuck off bottom while conveyed in the wellbore; a risk common when running a full string of casing. Such remediation activities may be operationally difficult and costly. According to embodiments of the present disclosure, the internal through bore 314 of the ECHH 302 may be configured to receive a variety of hanger profiles to secure subsequent tubular runs. The hanger profiles that may be received by the internal through bore 314 include but are not limited to, mandrel, flute, or slip type hangers. Accordingly, a subsequent wellbore section may be drilled and cased with a predetermined tubular as required and should the casing be set higher than planned, the operator may implement a different hanger type to accommodate.

The ECHH 302 further includes one or more side outlet valves 320 (two shown) positioned and defined within the sidewall of the body 304. The side outlet valve(s) 320 may be configured to facilitate fluid communication with and pressure monitoring of the through bore 314. The side outlet valves 320 may be angularly offset from each other about the outer circumference of the body 304. In the illustrated embodiment, for example the side outlet valves 320 are angularly offset from each other by 180°. In some embodiments, as illustrated, the side outlet valve(s) 320 may provide a studded flange connection, but could alternatively provide other types of connecting means, such as a threaded connection or the like. In some embodiments, as illustrated, the side outlet valve(s) 320 may extend radially outward from the outer circumference of the body 304. In other embodiments, however, the side outlet valve(s) 320 may be recessed so as to substantially align with the outer circumference of the body 304.

Regardless of the hanger type or subsequent wellhead housing installed atop the ECHH 302, the position of the side outlet valve(s) 320 enables the annulus defined between the interior of the surface casing 308 and the exterior body of any subsequent casing or tubing to be monitored and/or regulated.

In some embodiments, the ECHH 302 may further include a split lock ring 322 arranged about the body 304 and positioned axially below the side outlet valves 320. As the ECHH 302 is received within the LPWH 202 (FIG. 2), the split lock ring 322 may be configured to be received by the lock-ring groove 220 (FIG. 2) defined within the bowl 214 (FIG. 2). When properly received within the lock-ring groove 220, the lock-ring 322 may assist in reducing relative movement between the LPWH 202 and the ECHH 302 as well as any subsequent housings installed within the wellhead housing system 120.

The body 304 may further define an angled shoulder 324 provided axially below the lock-ring 322. The angled shoulder 324 may be configured to locate and rest on the landing shoulder 216 (FIG. 2) of the LPWH 202 (FIG. 2). Accordingly, the angle of the angled shoulder 324 may be the same as or substantially the same as the landing shoulder 216.

Still referring to FIG. 3, the ECHH 302 may be operatively coupled to an extended casing head housing running tool 318 (hereafter the "ECHH running tool 318") configured to help convey the ECHH 302 into the LPWH 202 (FIG. 2). Prior to running the final string (extension) of surface casing 308, the ECHH running tool 318 may be operatively coupled the ECHH 302 in preparation to make up the uppermost or final extension of surface casing 308 and then position the ECHH 302 within the LPWH 202.

The ECHH running tool 318 may be the same as or similar to the running tool 228 (FIG. 2) used to place the LPWH 202 (FIG. 2). As illustrated, for example, the ECHH running tool 318 includes a top sub 326, a mid-body 328, and a bottom sub 330. The mid-body 328 interposes the top and bottom subs 326, 328, which extend axially away from the mid-body 328 in opposing directions. The mid-body 328 exhibits a diameter that is greater than the diameters of both the top and bottom subs 326, 330. Further, the mid-body 328 may provide or otherwise define an external thread profile 332 configured to threadably mate with the internal thread profile 316 of the ECHH 302. In some embodiments, as illustrated, one or more elastomeric seals 334 (one shown) may also be optionally provided on the mid-body 328 and configured to sealingly engage a scaling surface (not shown) provided within the through bore 314 of the of the ECHH 302 when the ECHH running tool 318 is operatively coupled to the ECHH 302.

The top sub 326 may comprise a generally cylindrical hollow body with an upper box connection 336 configured to be operatively coupled to a conveyance means, such as the drill pipe 242. Similarly, the bottom sub 330 may comprise a generally cylindrical hollow body with a lower pin connection 338 configured to be operatively coupled to any desirable or necessary downhole component applicable to running the ECHH 302. In some embodiments, for example, the pin connection 338 may be configured to be operatively coupled to a jet sub (not shown) operable to clean (i.e., jet) the interior of the ECHH 302, which may help to increase the success of properly coupling the ECHH 302 to the LPWH 202.

With the ECHH running tool 318 coupled to the drill pipe 242, the ECHH running tool 318 may then be made up to the ECHH 302. The external thread profile 332 of the ECHH running tool 318 is mated to the internal thread profile 316 of the ECHH 302. Once the ECHH 302 and ECHH running tool 318 are made up (threaded), the combination is mated to the last string of the surface casing by means of threaded engagement (i.e., API threads). The ECHH running tool 318, ECHH 302, and surface casing 308 (collectively referred to as "the ECHH assembly") may then be lowered toward the LPWH 202 (FIG. 2) by adding extensions of drill pipe 242.

Figure 4:
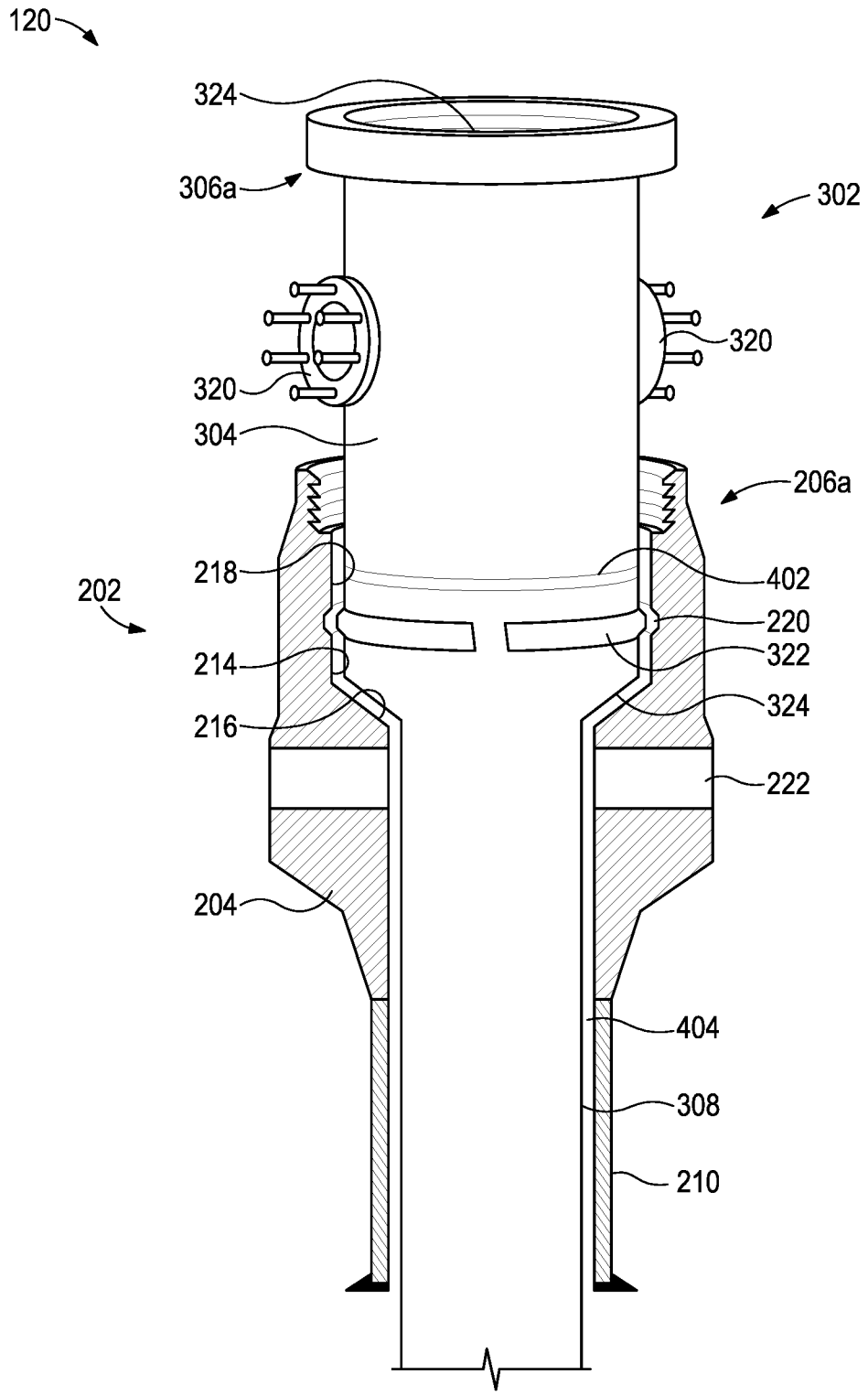
FIG. 4 is a schematic view of the example extended casing head housing of FIG. 3 received within the low-pressure surface wellhead housing unit of FIG. 2, according to one or more embodiments.

FIG. 4 is a schematic view of the ECHH 302 received within the LPWH 202, according to one or more embodiments. More specifically, FIG. 4 provides a schematic view of an example of at least a portion of the wellhead housing system 120 of FIG. 1, in accordance with the principles of the present disclosure. The ECHH 302 may be advanced into the bowl 214 of the LPWH 202 until the angled shoulder 324 of the ECHH 302 locates and rests on the internal landing shoulder 216 of the LPWH 202. Once the ECHH 302 is properly received within the LPWH 202, the upper end 306*a* of the ECHH 302 will extend some distance above the upper end 206*a* of the LPWH 202. This may prove advantageous in providing access to the side outlet valves 320 during operation of the wellhead housing system 120 (FIG. 1).

Moreover, in one embodiment, upon conveying the EECH 302 into the bowl 214, the split lock-ring 322 may be compressed and, upon locating the lock-ring groove 220, an axial and/or compressive force may be applied to force the lock-ring 322 radially outward such that it may lock into the lock-ring groove 220, thereby securing the ECHH 302. In another embodiment, the ECHH 302 may include an exterior tapered collar (not shown) arranged above (uphole from) the lock-ring 322 and operable, when engaged, to move downward, forcing the split lock-ring 322 into the lock-ring groove 220. In other embodiments, the ECHH running tool 318 may be operable to engage and set the lock-ring 322 into the lock-ring groove 220. In such an embodiment, the ECHH running tool 318 may be specifically configured for compatibility with the ECHH 302. In each embodiment, the split lock-ring 322 may help ensure that upon full installation of the wellhead housing system 120 (as well as intermittent installation and removal of a blowout preventer) the compressive loads of such additional components are transferred and distributed to the LPWH 202 and corresponding conductor casing(s).

In some embodiments, the ECHH 302 may also include a low pressure pack off or seal 402 disposed about the body 304 of the ECHH 302. The seal 402 may comprise, for example, an elastomeric seal axially positioned between the side outlet valves 320 and the split lock-ring 322. The seal 402 may be advantageous in wellhead housing systems 120 where the operator is aware of shallow hydrocarbon zone(s) (or similarly, shallow water flow hazards) that may be present within the formation at a depth between the conductor casing and the surface casing, thus creating a potential flow to surface. In such an embodiment, the seal 402 will generate a sealed interface between the exterior of the extended casing head housing 304 and the interior sealing surface 218 of the bowl 214, thereby preventing the shallow flow of formation fluids to surface. Accordingly, the annulus valve(s) 222 may be operable for testing the sealing efficiency between the interior sealing surface 218 and the seal 402.

With the split lock-ring 322 secured within the lock-ring groove 220, axial movement (which may occur when the well is put on production) between the housings is restricted (or potentially eliminated). Similarly, the configuration as presented allows the transmission of some portion of the compressive load from the ECHH 302 to the LPWH 202. In the present embodiment, the annulus valve(s) 222 defined within the sidewall of the LPWH 202 makes accessible a conductor-casing annulus 404 defined between the conductor 210 and the surface casing 308 such that it may be monitored for potential hydrocarbon or shallow water flow. As illustrated, the wellhead housing system 120 in its current state is configured and prepared for additional wellbore drilling, tubular running (e.g., casing or tubing), and wellhead housing installation.

As previously mentioned, subsea deep-water wells utilizing big-bore wellhead systems are capable of incorporating additional, large diameter conductor and/or casing strings to address concerns including the presence of highly unconsolidated shallow subterranean zones, potential shallow water and gas flows/hazards, and increasingly stringent zonal isolation requirements. However, such geological and zonal isolation requirements may not be limited to only deep-water wellbores. In some onshore and shallow water offshore applications, wellbores may endure similar geological features (e.g., shallow gas flows) that warrant the use of a secondary conductor string. Moreover, protection of fresh water aquifers is of particular importance and necessity in onshore wells. Accordingly, zonal isolation requirements may necessitate the installation of a secondary conductor string.

To accommodate a secondary conductor, most subsea large bore wellhead systems utilize a supplemental hanger that may be installed in a supplemental adapter positioned below a previously installed low-pressure wellhead housing. Contrary to the use of a supplemental adapter, surface positioned wellheads already implementing a second conductor utilize a different system and methodology.

In most cases, surface positioned wellheads configured for a secondary conductor require installation of a first conductor via conventional means, as described above, wherein the primary (or outermost) conductor is driven, hammered, or jet into place. When a secondary (or inner) conductor is required, this secondary string is similarly driven, hammered, or jet into place such that it is emplaced within the interior body of the outermost conductor and extends into the subterranean to a depth that exceeds the outermost (or primary) conductor. Subsequently, both primary and secondary conductors are cut such that some portion of both conductors extend upward (or above) the subterranean surface. In such examples, a casing housing support unit (CHSU) or "base plate" is utilized. However, the CHSU may only be welded to the primary conductor thereby negating any structural support that may be provided by the secondary conductor and leaving no means of monitoring nor accessing the annulus between the interior of the primary conductor and the exterior of the secondary conductor. Similarly, the conventional means of installing the CHSU is via onsite welding, and as discussed herein, onsite welding may be costly, time consuming, and lacking in scaling integrity. Further, the weld (implemented offsite or onsite) may be more susceptible to damage from fatigue loading, wellhead movement (whether during initial installation or during production) and subject to high compressive loads.

According to embodiments of the present disclosure the big bore surface wellhead housing system 120 of FIG. 1 may accommodate a secondary conductor by means other than those discussed directly above.

Figure 5:
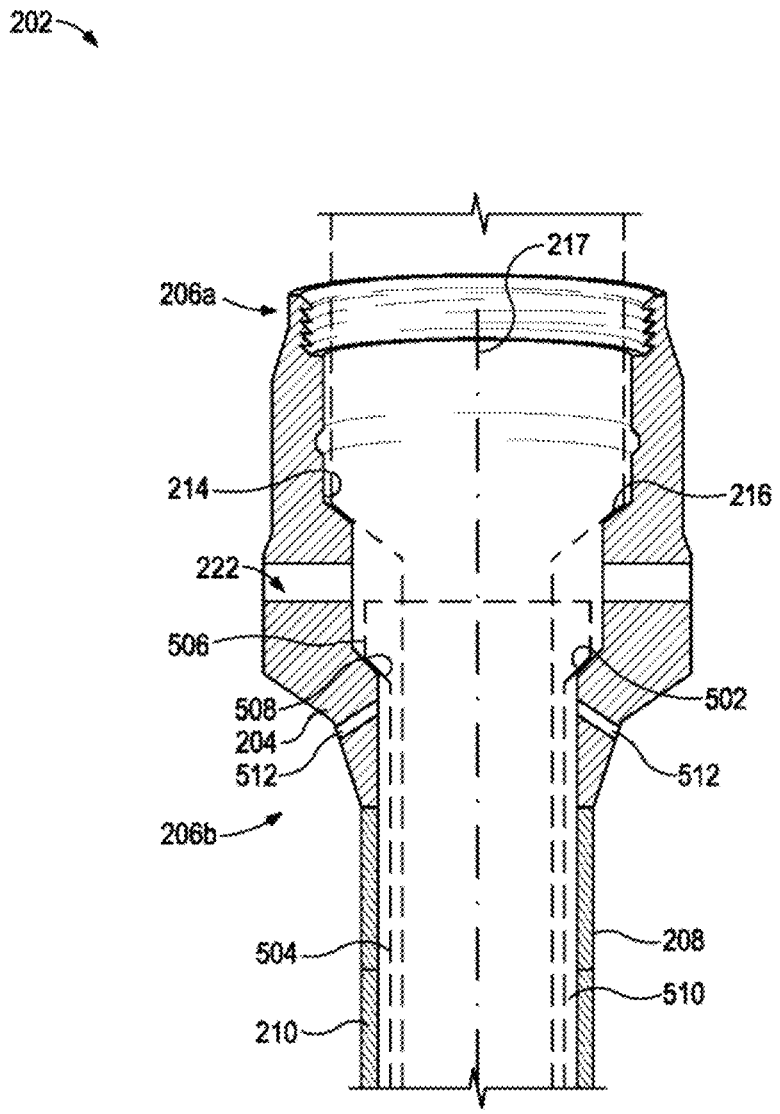
FIG. 5 is an enlarged, schematic diagram of another example of the low-pressure surface wellhead housing unit of FIG. 2, according to one or more additional embodiments of the disclosure.

FIG. 5 is an enlarged, schematic view of another example of the low-pressure surface wellhead housing unit 202, according to one or more additional embodiments of the disclosure. The LPWH 202 of FIG. 5 may be similar in some respects to the LPWH 202 shown in FIGS. 1 and 3 and, therefore, may be best understood with reference thereto, where like numerals will represent similar components not described again in detail. Similar to the LPWH 202 of FIGS. 1 and 3, for example, the LPWH 202 in FIG. 5 may be positioned by means of the conveyance (e.g., drill pipe 242 of FIG. 2) coupled to the running tool 228 (FIG. 2). Moreover, the LPWH 202 of FIG. 5 may include some of the same internal and external features of the LPWH 202 of FIGS. 1 and 3. For example, the LPWH 202 of FIG. 5 includes the body 204 having opposing upper and lower ends 206*a,b* and defining the interior bowl 214. The bowl 214 may define the angled landing shoulder 216 configured to receive and land the extended casing head housing 302 or "ECHH 302" (FIG. 3). Furthermore, the conductor 210 may be operatively coupled to and extend from the lower end 206*b* of the body 204 as generally described above. In some embodiments, the extension joint 208 may interpose the lower end 206*b* and the conductor 210, but in other embodiments, the extension joint 208 may be omitted and the conductor 210 may be directly welded to the lower end 206*b* at an offsite location and prior to delivery to the wellsite.

Unlike the LPWH 202 of FIGS. 1 and 3, however, the LPWH 202 of FIG. 5 includes a second or "lower" angled landing shoulder 502 located axially below the first landing shoulder 216. The second landing shoulder 502 may be configured to receive and land a second extension of conductor casing 504 (hereafter "conductor 504"; shown in dashed lines) attached to a conductor hanger 506 (shown in dashed lines) arranged concentric with the first conductor 210. The conductor hanger 506 may provide or otherwise define an opposing angled shoulder 508 configured to land on and mate with the second angled shoulder 502. In some embodiments, the second landing shoulder 502 may be angled about 45° relative to the centerline 217 of the LPWH 202. In other embodiments, however, the landing shoulder 216 may be provided at an angle greater than or less than 45°, without departing from the scope of the disclosure, and in order to receive the opposing angled shoulder 508.

The conductor 504 may prove advantageous for zonal isolation, environmental well integrity reasons, or to protect a fresh water aquifer prior to setting the surface casing with the ECHH 302 (FIG. 3). Moreover, having the LPWH 202 with the second landing shoulder 502 may prove advantageous in eliminating conventional practice of having a cemented free standing second size conductor string in offshore operations, where both the first and second conductor strings must be cut and the casing head support unit is welded to only the outer most conductor string, thereby leaving the second conductor without interaction with the outermost string or the rest of the wellhead system. Accordingly, the LPWH 202 of FIG. 5 may improve the operational efficiency of deploying the first and second conductor strings 210, 504 by eliminating flat times associated with cutting both conductor strings 210, 504 and welding the outermost conductor 210 to the casing head support unit as well as improving the quality of the resulting weld. The weld may be undertaken in a controlled environment offsite, thus eliminating cutting and welding activity on the critical path of well operations.

As illustrated, a conductor-conductor annulus 510 may be defined between the two conductors 210, 504, and the LPWH 202 may further include one or more monitoring outlets 512 (two shown) located below the second landing shoulder 502 and in fluid communication with the annulus 510. In the present embodiment, the LPWH 202 includes two monitoring outlet(s) 512 angularly offset from each other at 180°, but could alternatively only include a single monitoring outlet 512. The monitoring outlet(s) 512 may enable continuous monitoring of the integrity of the annulus 510, such as the real-time pressure within the annulus 510, which could enable early detection of shallow hydrocarbon flow to surface. The monitoring outlet(s) 512 may alternatively, or in addition, be utilized to interconnect an annulus shut off system (not shown). In at least one embodiment, the annulus shut off system may serve as a cement return port during the cementing process of the conductor 504.

Figure 6:
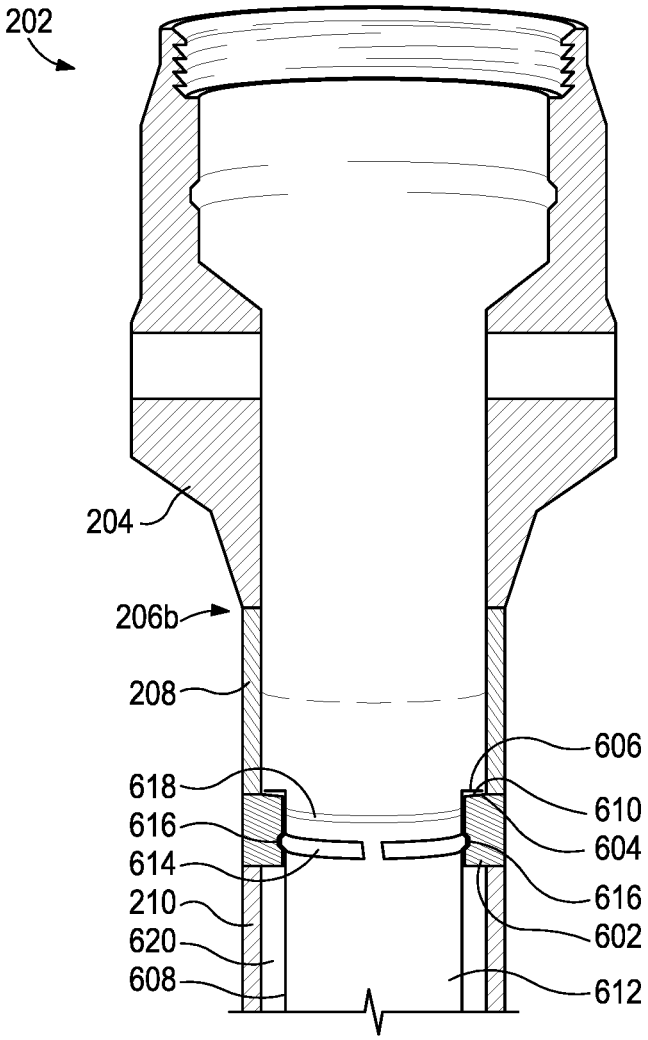
FIG. 6 is an enlarged, schematic diagram of another example of the low-pressure surface wellhead housing unit of FIG. 2, according to one or more embodiments of the present disclosure.

FIG. 6 is an enlarged, schematic view of another example of the low-pressure surface wellhead housing unit 202, according to one or more embodiments of the disclosure. The LPWH 202 of FIG. 6 may be similar in some respects to the LPWH 202 shown in FIGS. 1 and 3 and, therefore, may be best understood with reference thereto, where like numerals will represent similar components not described again in detail. Similar to the LPWH 202 of FIGS. 1 and 3, for example, the LPWH 202 in FIG. 6 may be positioned by means of the conveyance (e.g., drill pipe 242 of FIG. 2) coupled to the running tool 228 (FIG. 2). Moreover, the conductor 210 may be operatively coupled to and extend from the lower end 206*b* of the body 204 as generally described above.

Unlike the LPWH 202 of FIGS. 1 and 3, however, the LPWH 202 of FIG. 6 may include an adapter sub 602 secured at the interface between the extension joint 208 and the conductor 210. The adapter sub 602 may provide or define a positive load shoulder 604 configured to receive and mate with a conductor hanger 606 for a second extension of conductor casing 608 ("conductor 608") included as part of the conductor 210. The adaptor sub 602 may have a similar outer diameter as the conductor 210 and may exhibit a length of between about 10 feet and 20 feet. The conductor 608 may be configured as to be operable and compatible with conductor casings 210 ranging in size from 28 inch outer diameter to 36 inch outer diameter. In some embodiments, the adaptor sub 602 may exhibit similar or higher burst, collapse, and axial ratings as the outer most conductor 210.

Similar to the conductor hanger 506 (FIG. 5), the conductor hanger 606 may comprise a generally cylindrical body 612 that may provide or otherwise define an opposing angled shoulder 610 configured to land on and mate with the second angled shoulder 604. In some embodiments, the conductor hanger 606 may further include a split lock-ring 614 configured to be received by a split lock-ring 612 arranged about the body 612 and axially below the shoulder 610. In such an embodiment, the adapter sub 602 may define a split lock-ring groove 616 configured to receive the lock-ring 614. When properly received within the lock-ring groove 616, the lock-ring 614 may assist in reducing relative movement between the outermost conductor 210 and the second extension of conductor 608. Additionally, proper engagement of the lock-ring 614 transfers some portion of the hanger 606 load and pressure to the outermost conductor 210.

In some embodiments, as illustrated, one or more seals 618 (one shown) may also be provided on the body 612 and configured to sealingly engage the interior body of the adapter sub 602. The seal(s) 618 may be positioned axially below the shoulder 610 and above the split lock-ring 614 (in an embodiment that utilizes a split lock-ring 614). The seal(s) 618 may provide a barrier to fluid flow (or otherwise) in a conductor-conductor annulus 620 (i.e., the annulus between the conductor 210 and the conductor 608). The seal(s) 618 may be elastomeric, metal to metal, or similarly, some combination. Utilization of one or more seals may be particularly advantageous in a formation 108 wherein there is risk of shallow hydrocarbon or water flow. Accordingly, the seal(s) 618 comprise any known material considering the requirements and needs of the application.

Embodiments disclosed herein include:

A. A well system, the well system including a wellbore penetrating a subterranean formation, a conductor extended within the wellbore, and a wellhead installation arranged at an opening to the wellbore and securable to the conductor. The wellhead installation including a low-pressure surface wellhead housing (LPWH) having opposing upper and lower ends, an extension joint secured to the lower end of the LPWH at an offsite location prior to delivery to the wellbore, the extension joint being threadably engageable with an upper end of the conductor at the wellbore, an extended casing head housing (ECHH) providing a body having opposing first and second ends and sized to be received within the LPWH, the second end being secured to an uphole end of surface casing at an offsite location prior to delivery to the wellbore, and one or more annulus valves extending through a sidewall of the LPWH to provide fluid communication with a conductor-casing annulus defined between the conductor and the surface casing when the ECHH is received within the LPWH.

B. A method of assembling a wellhead installation, the method including receiving a low-pressure surface wellhead housing (LPWH) and an extended casing head housing (ECHH) at a wellbore of a well site, an extension joint being securable to a lower end of the LPWH at an offsite location prior to delivery to the wellbore, and an end of the ECHH being securable to an uphole end of surface casing at an offsite location prior to delivery to the wellbore. The method further including lowering the LPWH toward the wellbore and threading the extension joint to an upper end of a conductor extendable within the wellbore, lowering and receiving the ECHH within the LPWH, and facilitating communication with a conductor-casing annulus defined between the conductor and the surface casing with one or more annulus valves extending through a sidewall of the LPWH.

C. A low-pressure surface wellhead housing (LPWH) unit, the LPWH including a body having opposing upper and lower ends and providing an interior bowl, an extension joint secured to the lower end of the LPWH at an offsite location prior to delivery to a wellbore, the extension joint being threadably engageable with an upper end of a first conductor receivable within a wellbore. The LPWH further including a lower landing shoulder defined within the interior bowl and configured to receive and land a second conductor arranged concentric within the first conductor. The LPWH including an upper landing shoulder defined within the interior bowl axially above the lower landing shoulder and configured to receive and land an extended casing head housing (ECHH), the ECHH providing a body having opposing first and second ends, the second end being secured to an uphole end of surface casing at an offsite location prior to delivery to the wellbore. The LPWH including one or more monitoring outlets extending through a sidewall of the LPWH to provide fluid communication with a conductor-conductor annulus defined between the first and second conductors when the second conductor is received within the LPWH, and one or more annulus valves extending through a sidewall of the LPWH to provide fluid communication with a conductor-casing annulus defined between the conductor and the surface casing when the ECHH is received within the LPWH.

Each of embodiments A, B, and C may have one or more of the following additional elements in any combination: Element 1: wherein the lower end of the LPWH and the upper end of the extension joint are both finished with a plain end, and wherein the lower end of the LPWH is welded to the upper end of the extension joint. Element 2: wherein the second end of the ECHH and the uphole end of the surface casing are both finished with a plain end, and wherein the second end of the ECHH is welded to the uphole end of the surface casing. Element 3: wherein the second end of the ECHH and the uphole end of the surface casing are both finished with a plain end, and wherein the second end of the ECHH is welded to the uphole end of the surface casing. Element 4: wherein the lock-ring groove is positioned axially below the one or more annulus valves. Element 5: wherein the body of the ECHH defines an angled shoulder sealingly engageable with a landing shoulder provided within an interior of the LPWH when the ECHH is received within the LPWH. Element 6: wherein a seal is disposed about the body of the ECHH and sealingly engages a sealing surface defined within the interior of the LPWH when the ECHH is received within the LPWH. Element 7: wherein a through bore extends between the opposing first and second ends of the body of the ECHH, the ECHH further including one or more side outlet valves provided on the body to facilitate fluid communication with the through bore for pressure monitoring. Element 8: wherein a through bore extends between the opposing first and second ends of the body of the ECHH, the ECHH further including one or more side outlet valves provided on the body to facilitate fluid communication with the through bore for pressure monitoring.

Element 9: wherein receiving the LPWH at the well site is preceded by welding the lower end of the LPWH to the upper end of the extension joint at the offsite location. Element 10: wherein receiving the ECHH at the well site is preceded by welding the end of the ECHH to the uphole end of the surface casing at the offsite location. Element 11: wherein the LPWH defines a bowl defined within an interior of the LPWH and a lock-ring groove is defined in the bowl, and wherein lowering and receiving the ECHH within the LPWH comprises: receiving a split lock ring arrangeable about a body of the ECHH in the lock-ring groove; and securing the ECHH to the LPWH with the split lock ring. Element 12: wherein lowering and receiving the ECHH within the LPWH comprises sealingly engaging an angled shoulder provided by the ECHH against a landing shoulder provided within an interior of the LPWH. Element 13: wherein a through bore extends between opposing first and second ends of the ECHH, the method further comprising facilitating fluid communication with the through bore with one or more side outlet valves provided on the ECHH.

Element 14: wherein the LPWH further comprising one or more annulus valves extending through a sidewall of the LPWH to provide fluid communication with a conductor-casing annulus defined between the conductor and the surface casing when the ECHH is received within the LPWH. Element 15: wherein the lower end of the LPWH and an upper end of the extension joint are both finished with a plain end, and wherein the lower end of the LPWH is welded to the upper end of the extension joint. Element 16: wherein the one or more monitoring outlets enable continuous monitoring of the integrity of the conductor-conductor annulus. Element 17: wherein the one or more monitoring outlets are operable as cement returns ports when cementing the second conductor into the wellbore.

By way of non-limiting example, exemplary combinations applicable to A, B and C include: Element 3 with Element 4; Element 5 with Element 6; and Element 7 with Element 8.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a conductor operable to provide structural support and extending partially below a terranean surface so that an exposed portion of the conductor extends above the terranean surface; and a wellhead installation arranged at and operatively coupled to the exposed portion of the conductor, the wellhead installation including:

a low-pressure surface wellhead housing (LPWH) including a body having opposing upper and lower ends and providing an interior bowl with upper and lower landing shoulders axially spaced from one another by a vertical portion defined within and forming an integral part of the interior bowl;

an extension joint secured to the lower end of the LPWH, the extension joint threadably engageable with the exposed portion of the conductor;

a conductor hanger landed in the interior bowl on or above the lower landing shoulder, the conductor hanger being securable to an extension of conductor casing;

an extended casing head housing (ECHH) landed on the upper landing shoulder, the ECHH providing a body with opposing first and second ends and sized to be received and arranged concentrically within the LPWH and the conductor hanger, the second end being securable to an uphole end of surface casing; and one or more annulus valves extending through a sidewall of the LPWH to provide fluid communication with a conductor-casing annulus defined between the conductor and the surface casing when the ECHH is received within the LPWH.

2. The well system of claim 1, wherein a lock-ring groove is defined in the bowl, the wellhead installation further including a split lock ring arranged about the body of the ECHH and configured to be received by the lock-ring groove to secure the ECHH to the LPWH.

3. The well system of claim 2, wherein the lock-ring groove is positioned axially above the one or more annulus valves.

4. The well system of claim 1, wherein the body of the ECHH defines an angled shoulder sealingly engaged with the upper landing shoulder provided within an interior of the LPWH when the ECHH is received within the LPWH and the conductor hanger.

5. The well system of claim 4, wherein a seal is disposed about the body of the ECHH and sealingly engages a sealing surface defined within the interior of the LPWH when the ECHH is received within the LPWH.

6. The well system of claim 1, wherein a through bore extends between the opposing first and second ends of the body of the ECHH, the ECHH further including one or more side outlet valves provided on the body to facilitate fluid communication with the through bore for pressure monitoring.

7. The well system of claim 6, wherein the one or more side outlet valves are arranged above the upper end of the LPWH when the ECHH is received within the LPWH.

8. A method for assembling a wellhead installation, comprising:

driving a conductor below a terranean surface so that an exposed portion of the conductor extends above the terranean surface and a lower end of the conductor extends below the terranean surface;

lowering a low-pressure surface wellhead housing (LPWH), providing an interior bowl defining upper and lower landing shoulders separated by a vertical portion therebetween, the upper and lower landing shoulders and the vertical portion defined within and forming integral parts of the interior bowl, toward the conductor and threading an extension joint secured to a lower end of the LPWH to the exposed portion at an upper end of the conductor extended above the terranean surface;

landing a conductor hanger in the interior bowl on or above the lower landing shoulder, the conductor hanger being secured to an extension of conductor casing;

lowering and receiving an extended casing head housing (ECCH) within the LPWH and the conductor hanger, the ECCH being secured to an uphole end of surface casing;

landing the ECHH on the upper landing shoulder and concentrically within the LPWH and the conductor hanger; and facilitating communication with a conductor-casing annulus defined between the conductor and the surface casing with one or more annulus valves extending through a sidewall of the LPWH.

9. The method of claim 8, wherein lowering the LPWH is preceded by welding the lower end of the LPWH to the upper end of the extension joint.

10. The method of claim 8, wherein lowering and receiving the ECHH is preceded by welding the end of the ECHH to the uphole end of the surface casing.

11. The method of claim 8, wherein the LPWH includes a lock-ring groove defined within the bowl, and wherein lowering and receiving the ECHH within the LPWH comprises:

receiving a split lock ring arrangeable about a body of the ECHH in the lock-ring groove; and securing the ECHH to the LPWH with the split lock ring.

12. The method of claim 8, wherein lowering and receiving the ECHH within the LPWH comprises sealingly engaging an angled shoulder provided by the ECHH against the upper landing shoulder of the LPWH.

13. The method of claim 8, wherein a through bore extends between opposing first and second ends of the ECHH, the method further comprising facilitating fluid communication with the through bore with one or more side outlet valves provided on the ECHH.

14. A well system, comprising:

a first conductor extending partially below a terranean surface so that an exposed portion of the first conductor extends above the terranean surface; and a wellhead installation including:

an extension joint secured to the lower end of a low-pressure wellhead housing (LPWH), the extension joint threadably engageable with an upper end of the exposed portion of the first conductor;

the LPWH including:

a body having opposing upper and lower ends and providing an interior bowl;

a lower landing shoulder defined within and forming an integral part of the interior bowl to receive and land a mandrel-type hanger coupled to a second conductor arranged concentric within the first conductor;

an upper landing shoulder defined within and forming an integral part of the interior bowl axially above the lower landing shoulder to receive and land an extended casing head housing (ECHH) providing a body having opposing first and second ends, the second end being secured to an uphole end of an extension of surface casing;

a vertical portion positioned between the upper and lower landing shoulders, defined within and forming an integral part of the interior bowl, the vertical portion operable to land a slip-type hanger coupled to the second conductor arranged concentric within the first conductor;

one or more monitoring outlets extending through a sidewall of the LPWH; and one or more annulus valves extending through a sidewall of the LPWH.

15. The well system of claim 14, wherein the one or more annulus valves provide fluid communication with a conductor-casing annulus defined between the second conductor and the surface casing when the ECHH is received within the LPWH.

16. The well system of claim 14, wherein the lower end of the LPWH and an upper end of the extension joint are both finished with a plain end, and wherein the lower end of the LPWH is welded to the upper end of the extension joint.

17. The well system of claim 14, wherein the one or more monitoring outlets are disposed below the lower landing shoulder to enable continuous monitoring of the integrity of a conductor-conductor annulus defined between the first and second conductors when the second conductor is received within the LPWH.

18. The well system of claim 14 wherein the lower landing shoulder is angled 45° relative to a centerline of the LPWH and configured to receive an opposing angled shoulder of the second conductor.

19. The well system of claim 14, further comprising the second conductor landed into the LPWH on or above the lower landing shoulder concentrically within the LPWH.

20. The well system of claim 19, further comprising the ECHH landed on the upper landing shoulder and concentrically within the LPWH and the second conductor.

* * * * *